US009379472B2

(12) United States Patent
Hara

(10) Patent No.: US 9,379,472 B2
(45) Date of Patent: Jun. 28, 2016

(54) ELECTRIC CONNECTOR WITH ACCOMMODATING SHORTING TERMINAL

(71) Applicant: SUMITOMO WIRING SYSTEMS, LTD., Yokkaichi, Mie (JP)

(72) Inventor: Teruo Hara, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/480,815

(22) Filed: Sep. 9, 2014

(65) Prior Publication Data

US 2015/0079827 A1 Mar. 19, 2015

(30) Foreign Application Priority Data

Sep. 17, 2013 (JP) ..... 2013-191486

(51) Int. Cl.

| | |
|---|---|
| ***H01R 29/00*** | (2006.01) |
| ***H01R 13/46*** | (2006.01) |
| ***H01R 13/05*** | (2006.01) |
| ***H01R 13/422*** | (2006.01) |
| ***H01R 13/703*** | (2006.01) |
| ***H01R 13/436*** | (2006.01) |

(52) U.S. Cl.

CPC ..... *H01R 13/46* (2013.01); *H01R 13/05* (2013.01); *H01R 13/4223* (2013.01); *H01R 13/4361* (2013.01); *H01R 13/4364* (2013.01); *H01R 13/7032* (2013.01)

(58) Field of Classification Search

CPC .... H01R 13/46; H01R 13/05; H01R 13/4223; H01R 13/4361; H01R 13/4364; H01R 13/7032

USPC ..... 439/188, 489

See application file for complete search history.

(56) References Cited

U.S. PATENT DOCUMENTS

| | | | | | |
|---|---|---|---|---|---|
| 5,145,356 | A * | 9/1992 | Minnis | B60R 21/01 | 439/188 |
| 5,863,216 | A * | 1/1999 | Tsuji | H01R 13/7031 | 439/489 |
| 5,997,344 | A * | 12/1999 | Shinozaki | H01R 13/5213 | 439/188 |
| 6,045,395 | A * | 4/2000 | Saito | H01R 13/641 | 439/354 |
| 6,126,496 | A * | 10/2000 | Shinozaki | H01R 13/7033 | 439/862 |
| 6,171,124 | B1 * | 1/2001 | Kojima | H01R 13/7032 | 200/51.1 |
| 6,827,596 | B2 * | 12/2004 | Hori | H01R 13/6275 | 439/188 |
| 7,294,015 | B2 * | 11/2007 | Fujii | H01R 13/641 | 439/489 |
| 7,445,491 | B2 * | 11/2008 | Fujii | H01R 13/62938 | 439/157 |

(Continued)

*Primary Examiner* — Hae Moon Hyeon
*Assistant Examiner* — Peter G Leigh
(74) *Attorney, Agent, or Firm* — Gerald E. Hespos; Michael J. Porco; Matthew T. Hespos

(57) ABSTRACT

Cavities (13A) in which first terminal fittings (30A) are accommodated are at one side of shorting terminal accommodating chambers (17) arranged between cavities (13) in a height direction. Second cavities (13B) in which second terminal fittings (30B) are at the other side in the height direction. An escaping portion (23) is formed on a partition wall (22) between the shorting terminal accommodating chamber (17) and the second cavities (13B) in which the second terminal fittings (30B) are accommodated and allows resilient contact pieces (41) deformed by a short releasing portion (84) to escape. A front holder (70) is mounted on the front surface of a housing (10) and includes insulating portions (75) for insulating between the resilient contact pieces (41) and the second terminal fittings (30B) by being located at the side of the second cavities (13B) at the other side of the escaping portions (23) in the height direction.

6 Claims, 12 Drawing Sheets

(56) References Cited

U.S. PATENT DOCUMENTS 7,488,197 B2 * 2/2009 Shinozaki ..... H01R 12/716 439/489
7,850,471 B2 * 12/2010 Imai ..... H01R 13/7032 200/51.1
8,011,977 B2 * 9/2011 Tsuruta ..... H01R 13/4365 439/752
8,366,493 B2 * 2/2013 Nakamura ..... H01R 13/4223 439/752
8,485,836 B2 * 7/2013 Nakamura ..... H01R 13/4223 439/188
8,851,921 B2 * 10/2014 Segawa ..... H01R 13/6271 439/489
2007/0054547 A1 * 3/2007 Ohtaka ..... H01R 13/7032 439/507
2008/0268693 A1 * 10/2008 Nakamura ..... H01R 13/4362 439/347
2009/0035980 A1 * 2/2009 Nakamura ..... H01R 13/641 439/352

* cited by examiner

ELECTRIC CONNECTOR WITH ACCOMMODATING SHORTING TERMINAL

BACKGROUND

1. Field of the Invention

The invention relates to a connector.

2. Description of the Related Art

A known connector has a housing in which terminal fittings and a shorting terminal are accommodated. The shorting terminal shorts the terminal fittings when the connector is not connected to a mating connector. However, a short releasing portion in the mating connector releases a shorted state of the terminal fittings when the connector is connected properly to the mating connector.

The shorting terminal in a connector of this type generally has resilient contact pieces to be brought into contact with terminal fittings and the resilient contact pieces that are formed to be resiliently deformable in a vertical direction. A tip part of the resilient contact piece is formed into an inverted V shape and the apex thereof serves as a contact portion to be brought into contact with the terminal fitting. An obliquely extending part located before the contact portion in a connecting direction defines a guide for guiding the short releasing portion to between the contact portion and the terminal fitting. The guide needs to have a suitable length to fully exhibit a function of guiding the short releasing portion.

There has been a demand to miniaturize a shorting terminal by reducing the height of the shorting terminal as much as possible. However, the resilient contact pieces are deformed resiliently a large amount in a height direction when being pressed by the short releasing portion, the shorting terminal needs to have a suitable height so that the tip of the guiding portion extending long does not contact a wall of a shorting terminal accommodating chamber.

U.S. Pat. No. 6,171,124 discloses a connector with a housing that has an opening on a wall of the shorting terminal accommodating chamber for allowing the tips of the resilient contact pieces to escape in the housing, thereby preventing the contact of the resilient contact pieces and reducing the height of the shorting terminal. However, the shorting terminal accommodating chamber and cavities provided therebelow communicate by the opening provided on the wall of the shorting terminal accommodating chamber. Thus, there has been a problem of a possibility of electrically shorting the terminal fitting and the terminal fitting located below even though they are not supposed to be in contact.

The present invention was completed based on the above situation and aims to provide a connector capable of combining the miniaturization of a shorting terminal and the securement of insulation performance.

SUMMARY OF THE INVENTION

The invention relates to a connector with a housing with first cavities and second cavities. First terminal fittings that are to be shorted are accommodated respectively in the first cavities and second terminal fittings that are not to be shorted are accommodated in the second cavities. The housing further has a shorting terminal accommodating chamber and at least one shorting terminal in the shorting terminal accommodating chamber. The shorting terminal has at least one resilient contact piece configured for contacting the first terminal fittings in the first cavities to short the first terminal fittings when the connector is not connected with a mating connector. A short releasing portion is provided in the mating connector and is inserted between the first terminal fittings and the resilient contact pieces of the shorting terminal when the connector is connected properly with the mating connector to release the shorted state. The first cavities for accommodating the first terminal fittings are provided at one side of the shorting terminal accommodating chamber in an arrangement direction and the second cavities for accommodating second terminal fittings are provided at the other side of the shorting terminal accommodating chamber in the arrangement direction. Escaping portions are formed on the partition wall between the shorting terminal accommodating chamber and the second cavities. The escaping portions allow the resilient contact pieces to escape when deformed by the short releasing portion.

With the above described configuration, the resilient contact pieces pressed by the short releasing portion are deformed into the escaping portion. Thus, the height of the shorting terminal can be reduced.

The connector may further comprise a front holder mounted on the front surface of the housing. The front holder includes at least one insulating portion for insulating between the resilient contact pieces and the second terminal fittings by preventing the entrance of the resilient contact pieces from the escaping portion. Thus, the insulating portion of the front holder provides insulation between the resilient contact pieces and the second terminal fittings, which are not supposed to be shorted. Accordingly, an electrical short circuit between the shorting terminal and the second terminal fittings can be prevented reliably. Thus, miniaturization of the shorting terminal and an improvement in insulation performance can be combined.

The insulating portion may be disposed and dimensioned to close substantially the entire escaping portion without leaving any clearance.

A resin locking lance may extend from the partition wall and may be provided in the second cavity. The resin locking lance may be configured to lock and retain the second terminal fitting in the second cavity. Additionally, the insulating portion and the partition wall are at substantially the same position in the height direction. According to this configuration, the height of the housing can be reduced and the miniaturization of the housing can be realized as compared with the case where the insulating portion and the resin locking lance are at positions completely displaced in the height direction.

A shorting opening may be provided on a partition wall between the shorting terminal accommodating chamber and the first cavities. One or more contact portions of the shorting terminal may project into the first cavities through the shorting opening and may contact the first terminal fittings.

The shorting opening may penetrate through the partition wall in the arrangement direction and/or is open forward.

A rear wall may be provided at or near a rear part of the shorting terminal accommodating chamber for preventing the shorting terminal from moving backward in the shorting terminal accommodating chamber.

The front holder may be mounted to at least partly cover the housing from front.

An excessive deflection preventing portion may be provided adjacent to the resilient contact piece and may be configured for preventing excessive deflection of the resilient contact piece.

Accordingly, the above-described invention enables miniaturization of a shorting terminal and the secure insulation performance.

These and other objects, features and advantages of the invention will become more apparent upon reading the following detailed description and accompanying drawings.

DETAILED DESCRIPTION

A female connector in accordance with an embodiment of the invention is identified generally by the letter F in FIGS. 1-12. The connector F includes a female housing 10 that holds first and second female terminal fittings 30A and 30B and shorting terminals 40 for shorting specific first terminal fittings 30A.

Figure 1:
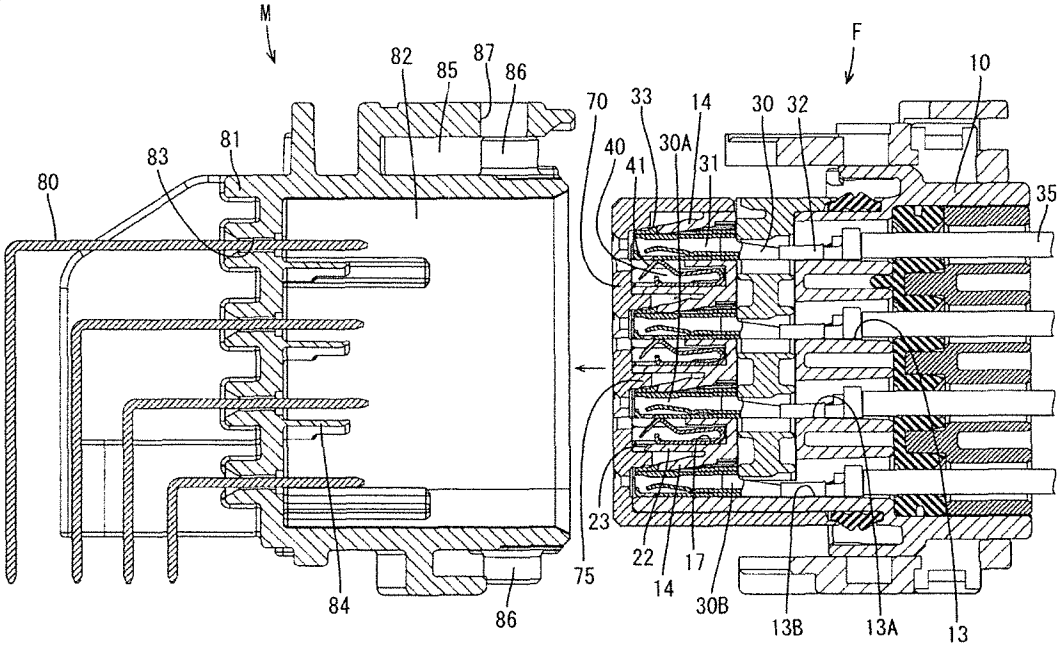
FIG. 1 is a section showing a state before a female connector and a male connector according to an embodiment are connected.

The female connector F is connectable to a mating male connector M. The female and male connectors F, M form part of a lever-type connector whose connecting and separating operations are assisted or performed by rotating a lever 50 provided in or on the female connector F. In the following description, an end to be connected to a mating end is referred to as the front and an opposite end thereof is referred to as a rear in each member F, M, and upper and lower sides of FIG. 1 are referred to as upper and lower sides.

The male housing 81 is made e.g. of a synthetic resin and includes connector fittings 82 into which the female connectors F can be inserted. Each) connector fitting portion 82 is open forward, and the female connector F can be fit tightly therein. Although not shown, the connector fittings 82 are provided side by side in a lateral or height direction and the male housing 81 is shaped to be wide in the lateral direction as a whole.

The male connector M includes male terminal fittings 80 and a male housing 81 for holding the male terminal fittings 80. The male connector M is a board connector and the male terminal fittings 80 extending from the male housing 81 are to be connected to an unillustrated board.

The male housing 81 is made e.g. of a synthetic resin and includes connector fittings 82 into which the female connectors F are fit individually. Each connector fitting 82 is open forward, and the female connector F is fit tightly therein. Although not shown, the connector fittings 82 are provided side by side in a lateral or height direction and the male housing 81 is long in the lateral direction.

The male terminal fitting 80 is formed by bending a substantially square electrically conductive wire material into an L shape and is held by being press-fit into a terminal insertion hole 83 formed on a back wall of each connector fitting portion 82. One end of male terminal fitting 80 projects forward from the back wall of the connector fitting portion 82 to be electrically connectable to the female terminal fitting 30, and the other end extends back from the rear surface of the male housing 81 and is connected to the unillustrated board, such as by soldering, gluing, brazing, press-fitting or the like.

The connector fitting portion 82 includes short releasing portions 84 that are inserted between the female terminal fittings 30 and the shorting terminals 40 to release a short circuit therebetween. The short releasing portions 84 project forward from the back wall of the connector fitting portion 82.

The male housing 81 includes lever accommodating portions 85 in which levers 50 are accommodated when the connectors F, M are connected. As many lever accommodating portions 85 as the connector fitting portions 82 are provided above the connector fitting portions 82.

The male housing 81 includes as many upper and lower cylindrical cam pins 86 as the connector fitting portion 82. Further, lock holes 87 are provided on the upper surface of the male housing 81 for receiving lock projections 51 provided on the levers 50. As many lock holes 87 as the connector fitting portion 82 are provided.

The female connector F is formed by mounting the lever 50 on the female housing 10 capable of holding the female terminal fittings 30. The female housing 10 is made of synthetic resin and defines a substantially rectangular block as a whole. Female terminal fittings 30 and shorting terminals 40 are accommodated therein.

The female terminal fitting 30 is connected to an end of a wire 35 and is formed into a shape long and narrow shape in a front-back direction such as by press-working, folding and/or embossing an electrically conductive metal plate. A front portion of the female terminal fitting 30 defines a rectangular tubular connecting portion 31 into which the male terminal fitting 80 is to be inserted from the front, and a rear portion thereof defines a wire connection portion with at least one barrel 32) to be crimped into connection) to the end of the wire 35.

The female terminal fitting 30 includes primary and secondary locks 33 and 34. The primary lock 33 is a projection on the upper surface of the connecting portion 31 and is to be locked by a resin locking lance 14 to be described later. The secondary lock 34 is the rear end of the connecting portion 31 and is to be locked by a retainer 60 to be described later.

Figure 6:
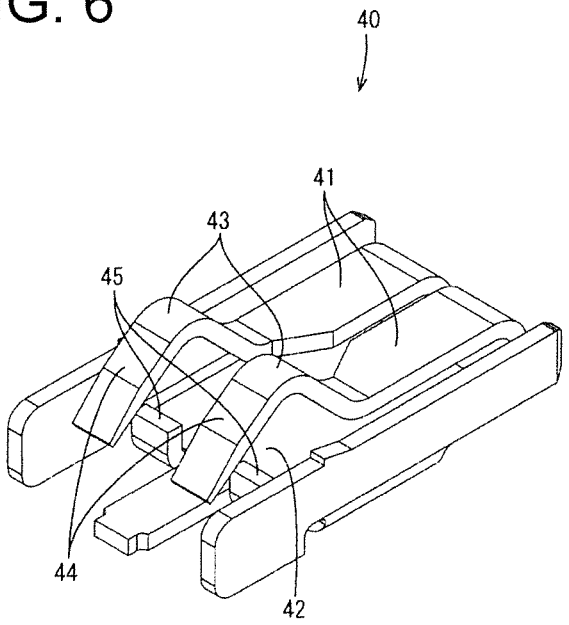
FIG. 6 is a perspective view showing a shorting terminal.

The shorting terminal 40 is formed by press-working an electrically conductive metal plate and has two resilient contact pieces 41 that can resiliently contact the female terminal fittings 30 (see FIG. 6). The resilient contact pieces 41 are folded to cantilever forward from the rear end of a base plate 42 and can deform vertically about the folds in directions intersecting a longitudinal extension of the female terminal fittings 41.

A tip part of the resilient contact piece 41 is formed into an inverted V shape, and the apex thereof defines a contact portion 43 to contact the female terminal fitting 30. Further, a part of the resilient contact piece 41 before the contact portion 43 defines as a guide 44 for guiding the short releasing portion 84 between the contact portion 43 and the female terminal fitting 30. The guiding portion 44 extends obliquely down and has a suitable length to fully exhibit a function of guiding the short releasing portion 84.

An excessive deflection preventing portion 45 is provided below the resilient contact piece 41 for preventing excessive deflection of the resilient contact piece. The excessive deflection preventing portion 45 is formed by bending a part of the base plate 42 up.

Figure 4:
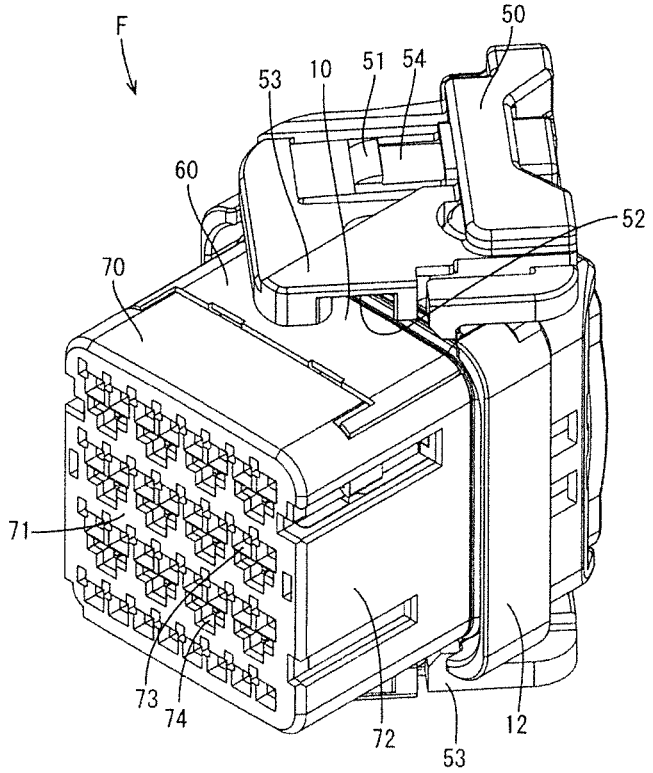
FIG. 4 is a perspective view of the female connector.
Figure 5:
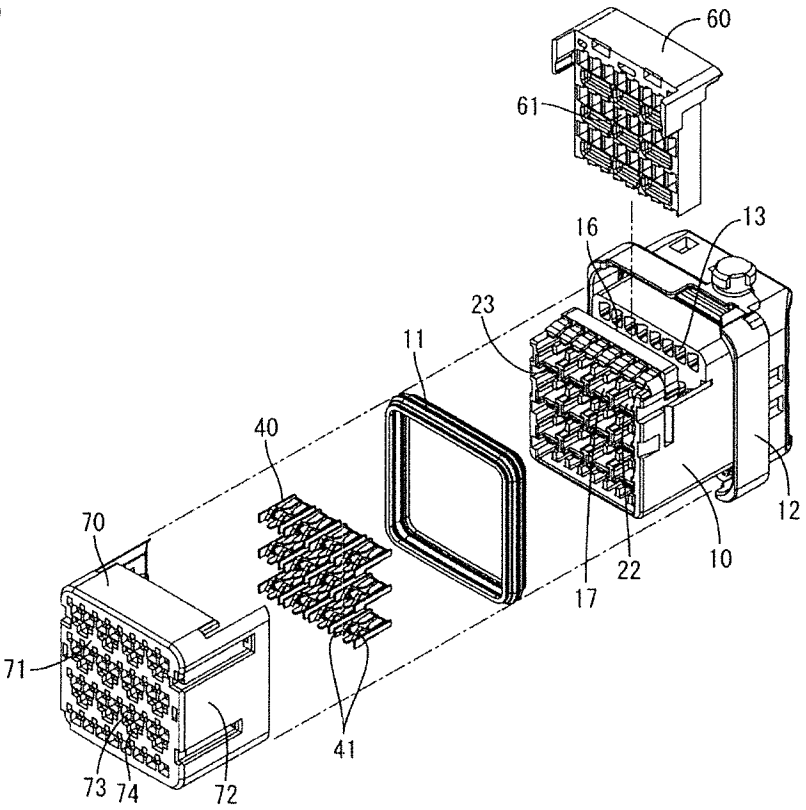
FIG. 5 is an exploded perspective view showing the female connector.

The lever 50 for assisting a connecting operation to the male connector M is mounted rotatably on the female housing 10 (see FIG. 4). The lever 50 has two cam plates 53 each formed with a cam groove 52 and an operating portion (not shown) coupling the cam plates 53 to define a substantially U-shape.

Entrances of the cam grooves 52 face forward at an initial position of the lever 50. The connectors F, M are connected lightly so that the cam pins 86 enter the cam grooves 52 when. The cam pins 86 move along the cam grooves 52 as the lever 50 is rotated from the initial position toward a connection position and the two connectors F, M are pulled together by a cam action based on the engagement of the cam pins 86 and the cam grooves 52. The cam pins 86 are at the back ends of the cam grooves 2 and the two connectors F, M are connected properly when the lever 50 reaches the connection position.

The cam plate 53 includes a lock arm 54 that is resiliently deformable in a plate thickness direction of the cam plate 53, and the lock projection 51 is formed in a lengthwise central part of the lock arm 54. The lock projection 51 is fits into the lock hole 87 of the male connector M to lock the two connectors F, M in a properly connected state.

A substantially rectangular seal ring 11 is fit on the outer peripheral surface of the female housing 10. In the properly connected state of the female and male connectors F, M, the seal ring 11 is sandwiched between the outer peripheral surface of the female housing 10 and the inner peripheral surface of the connector fitting 82 to hold the interior of the connector fitting 82 in a sealed state (see FIG. 3). Note that a receptacle 12 to be fit externally on the connector fitting 82 is provided outside the seal ring 11 to cover the seal ring 11.

The female housing 10 includes cavities 13 for accommodating the female terminal fittings 30 crimped to the ends of the wires 35. In this embodiment, the cavities 13 are formed in each of four separate stages.

The resin locking lance 14 is cantilevered forward from the upper surface of each cavity 13. A deformation space 15 is provided between the resin locking lance 14 and the upper surface of the cavity 13 (see FIG. 9) to allow upward resilient deformation of the resin locking lance 14. The deformation space 15 has a front side that is wider in the vertical direction than a rear side.

The resin locking lance 14 is pressed by the primary lock 33 of the female terminal fitting 30 and deforms resiliently up as the female terminal fitting 30 is inserted into the respective cavity 13. The primary lock 33 is located before the tip of the resin locking lance 14 when the female terminal fitting 30 is inserted to a proper position. As a result, the resin locking lance 14 resiliently restores and the tip thereof is locked to the primary lock 33 from behind (see FIG. 1) so that the female terminal fitting 30 is retained.

The female housing 10 includes a retainer inserting portion 16 into which the retainer 60 is to be inserted. The retainer inserting portion 16 is a hole that is open in a central part of the upper surface of the female housing 10 in the front-back direction and communicates with all of the cavities 13 (see FIG. 9).

The retainer 60 is made of synthetic resin and through holes 61 penetrate through the retainer 60 in the front-back direction at positions corresponding to the respective cavities 13. A retaining portion 62 is provided at the front of the upper surface of each through hole 61 for retaining the secondary lock 34 of the female terminal fitting 30 (see FIG. 2).

The retainer 60 can be held, with respect to the female housing 10, at a partial locking position where the retaining portions 62 are retracted up from the cavities 13 and a full locking position where the retaining portions 62 are located in the cavities 13. The retainer 60 is held at the partial locking position before the female terminal fittings 30 are inserted to enable forward movements of the connecting portions 31 of the female terminal fittings 30. The retainer 60 is pushed to the full locking position after the female terminal fittings 30 are inserted to retain the female terminal fittings 30.

The female housing 10 includes shorting terminal accommodating chambers 17 for accommodating the shorting terminals 40. The shorting terminal accommodating chambers 17 are provided between the cavities 13 in the vertical direction. Specifically, the shorting terminal accommodating chambers 17 are provided respectively between the cavities 13 in the uppermost stage and those in the second stage from top, between the cavities 13 in the second stage and those in the third stage and between the cavities 13 in the third stage and those in the fourth stage.

The female terminal fittings 30 include first terminal fittings 30A that are that are in first cavities 13A on a first or upper side of the shorting terminal accommodating chamber 17 in the height direction and that are to be shorted by the shorting terminal 40. The female terminal fittings 30 further include second terminal fittings 30B that are in the second cavities 13 on a second or lower side of the shorting terminal accommodating chamber 17 in the height direction and that are not to be shorted by the shorting terminal 40.

The shorting terminal accommodating chamber 17 is open forward and the shorting terminal 40 can be inserted therein from the front. The shorting terminal accommodating chamber 17 has a width extending over two first cavities 13A provided thereabove in the width direction. Note that the shorting terminal accommodating chamber 17 is formed in a part of the female housing 10 before the retainer inserting portion 16.

A shorting opening 19 is provided on an upper partition wall 18 between the shorting terminal accommodating chamber 17 and the first cavities 13A (see FIG. 10), and a forwardly open shorting opening 19 penetrates through the upper partition wall 18. The contact portions 43 of the shorting terminal 40 project into the first cavities 13A through the shorting opening 19 to contact the first terminal fittings 30A.

Figure 10:
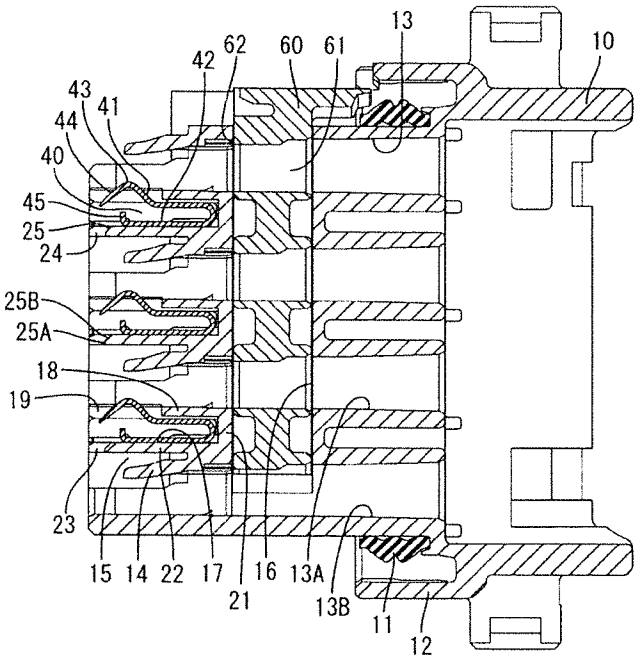
FIG. 10 is a section showing a state after the shorting terminals are accommodated into the female connector.

A rear wall 21 is provided at a rear part of the shorting terminal accommodating chamber 17 and a part of the shorting terminal accommodating chamber 17 behind the shorting opening 19 has a substantially bag-like shape surrounded on four sides and a rear side by walls (see FIG. 10). The rear wall 21 retains the shorting terminal 40 in the shorting terminal accommodating chamber 17 so as not to move backward.

A lower partition wall 22 is between the shorting terminal accommodating chamber 17 and the second cavities 13B and an escaping portion 23 penetrates through the lower partition wall 22.

Figure 11:
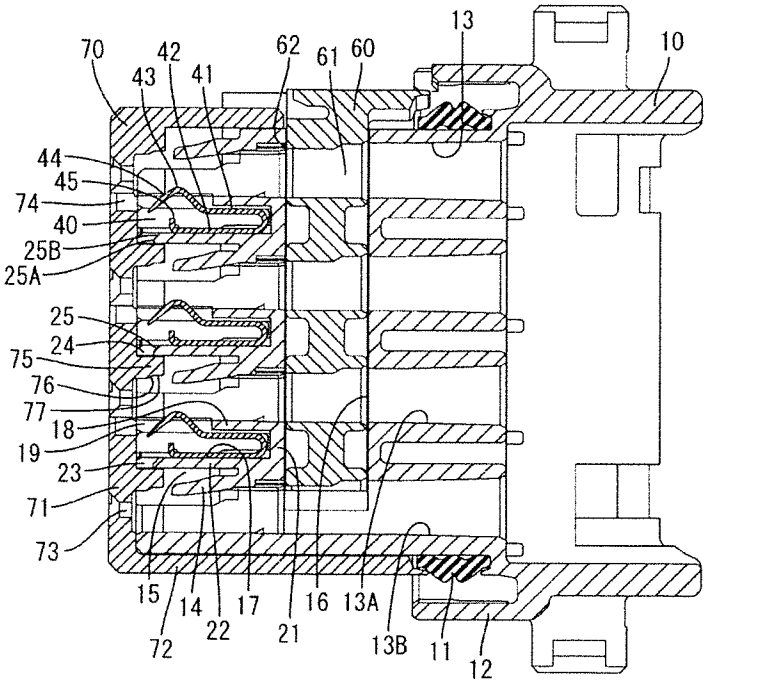
FIG. 11 is a section showing a state where the front holder is mounted on the female connector.

As shown in FIG. 11, a front holder 70 is mounted on the front of the female housing 10. The front holder 70 is made of a synthetic resin and includes a front wall 71 that forms a front wall of the female housing 10 when the front holder 70 is mounted on the female housing 10. A tubular side wall 72 projects back from the outer periphery of the front wall 71. Thus, the front holder 70 defines a rearwardly open bottomed tube. The front holder 70 is mounted to cover the female housing 10 from front.

In a state where the front holder 70 is mounted on the female housing 10, the rear end of the side wall 72 of the front holder 70 faces the front end of the seal ring 11 to prevent the seal ring 11 from being detached forward.

As shown in FIG. 11, the front wall 71 of the front holder 70 includes terminal insertion openings 73 at positions corresponding to the respective cavities 13, and the male terminal fittings 80 are insertable into the cavities 13 from the front through the terminal insertion openings 73. The front wall 71 of the front holder 70 includes short releasing holes 74 at positions corresponding to the respective shorting openings 19. The short releasing portions 84 are insertable through the short releasing holes 74 and into the shorting openings 19 from the front. The front wall 71 of the front holder 70 includes insulating portions 75 to be described in detail later.

The escaping portion 23 is formed on the lower partition wall 22 between the shorting terminal accommodating chamber 17 and the second cavities 13B (see FIG. 3) to allow escape of the resilient contact pieces 41 that have been pressed and resiliently deformed by the short releasing portion 84. The escaping portion 23 is formed on a tip part of the lower partition wall 22, and has a wide rectangular forwardly open shape.

Figure 7:
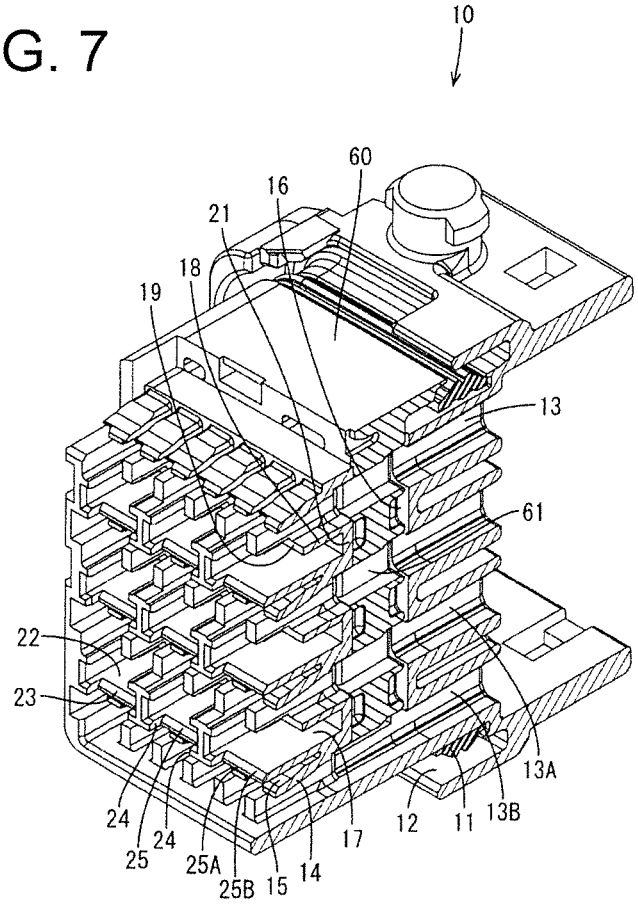
FIG. 7 is a perspective view in section showing the internal structure of the female connector in a state where the shorting terminals are not accommodated.
Figure 8:
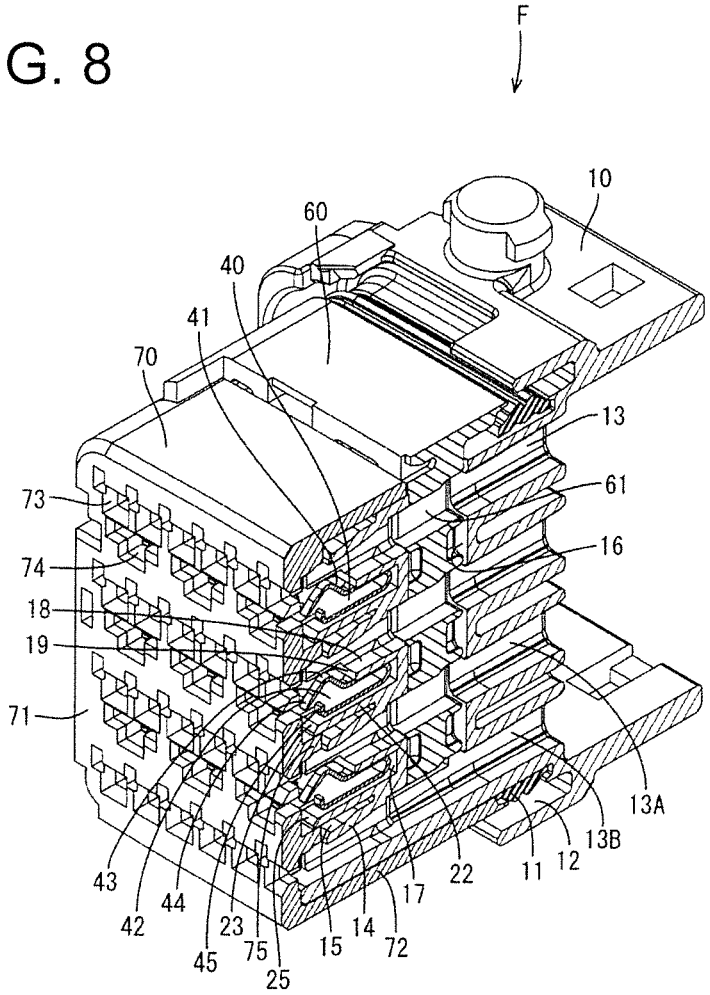
FIG. 8 is a perspective view in section showing the internal structure of the female connector in a state where the shorting terminals are accommodated and a front holder is mounted.
Figure 12:
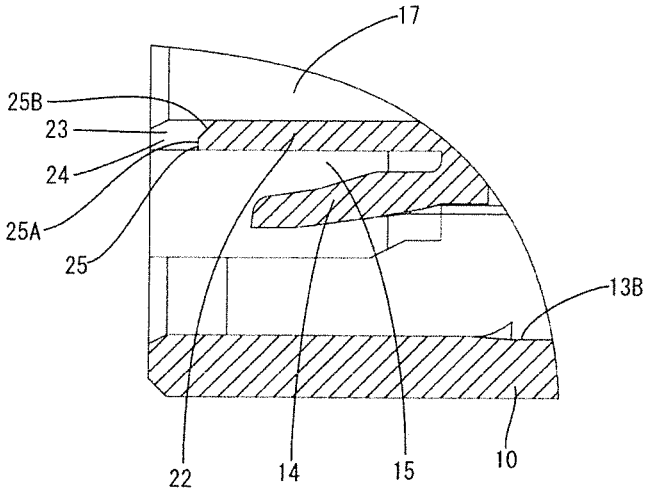
FIG. 12 is an enlarged view of FIG. 9 showing an escaping portion.

As shown in FIG. 7, the escaping portion 23 is defined by two side edges 24 and a rear edge 25. The side edges 24 are perpendicular to a wall surface of the low partition wall 22. As shown in FIGS. 7 and 12, the rear edge 25 has a vertical surface 25A perpendicular to the wall surface of the lower partition wall 22 and an inclined surface 25B. The vertical surface 25A is connected to a lower side of the inclined surface 25B. The inclined surface 25B is inclined down toward the front, and an opening dimension of the escaping portion 23 in the front-back direction is small at a lower side and gradually widened toward an upper side.

The escaping portions 23 are provided in all of the shorting terminal accommodating chambers 17 and are arranged before the resin locking lances 14 of the second cavities 13B provided below the shorting terminal accommodating chambers 17. The escaping portions 23 have the same size and same shape in all the shorting terminal accommodating chambers 17.

Figure 3:
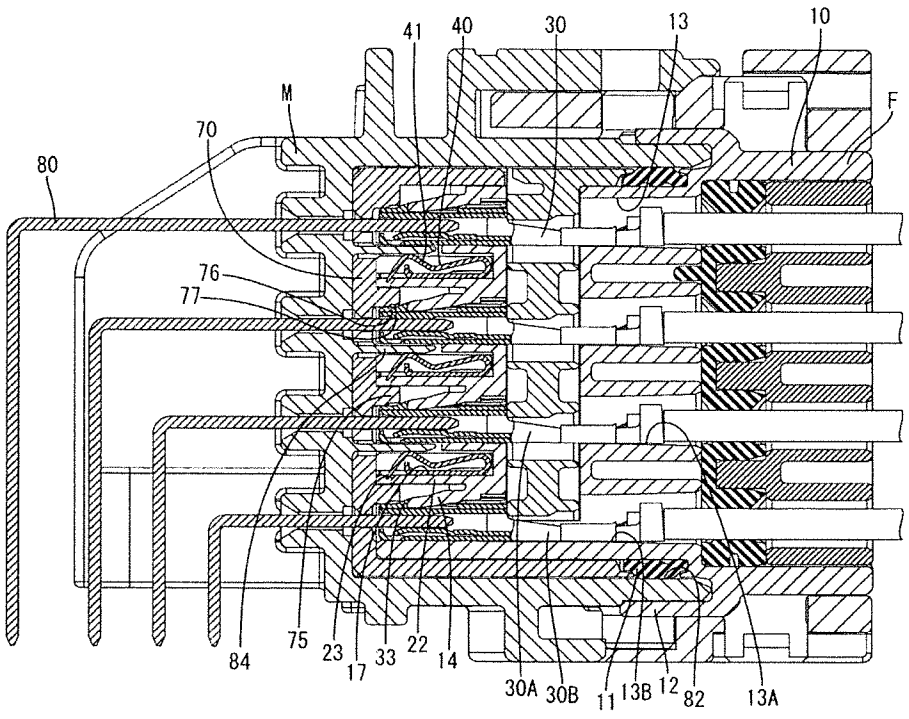
FIG. 3 is a section showing a state where the female and male connectors are properly connected.

As shown in FIG. 3, the front holder 70 includes the insulating portions 75 for insulating between the resilient contact pieces 41 and the second terminal fittings 30B. The insulating portions 75 are at positions below and corresponding to the escaping portions 23 of the female housing 10 and define walls projecting back from the rear surface of the front wall 71 of the front holder 70. The insulating portions 75 are below the escaping portions 23 (above the second cavities 13B) when the front holder 70 is mounted on the female housing 10.

As shown in FIG. 11, the insulating portions 75 dimensioned to close the entire escaping portions 23 without leaving any clearance. When the front holder 70 is mounted on the female housing 10, projecting end parts of the insulating portions 75 are proximate to or in contact with the lower surfaces of the lower partition walls 22.

As shown in FIG. 11, the height of the insulating portion 75 is slightly larger in a substantially front half in the front-back direction than in a substantially rear half. A step 76 is formed between a front part and a rear part on the lower surface of the insulating portion 75. A part of the lower surface of the insulating portion 75 behind the step 76 defines a recess 77 that is recessed up and prevents interference of the primary lock 33 of the female terminal fitting 30 with the insulating portion 75 (see FIG. 3). Note that the upper surface of the insulating portion 75 is a flat surface unlike the lower surface.

The height of the front part of the insulating portion 75 is slightly smaller than that of the resin locking lance 14 (vertical dimension between the lower surface of the lower partition wall 22 and the lower surface of the tip of the resin locking lance 14). In other words, the insulating portion 75 is in a positional relationship to overlap (face) the resin locking lance 14 in the height direction.

Figure 9:
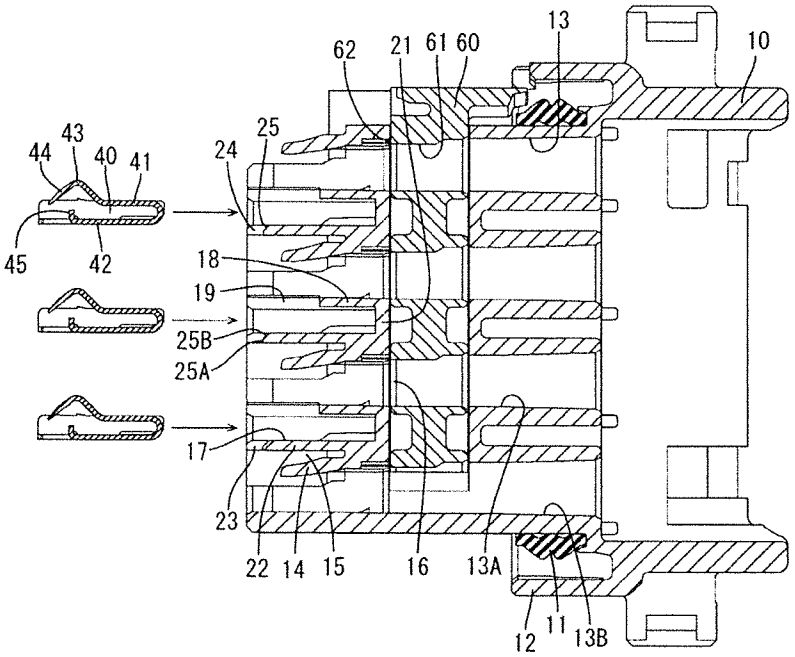
FIG. 9 is a section showing a state before the shorting terminals are accommodated into the female connector.

Assembly of the female connector F may start by inserting the shorting terminal 40 into each shorting terminal accommodating chamber 17 (see FIGS. 9 and 10). The shorting terminal 40 is pushed and accommodated into the shorting terminal accommodating chamber 17 by an unillustrated pushing pin. Then, the shorting terminal 40 is press-fitted and held in a rear part of the shorting terminal accommodating chamber 17 in such a posture that the contact portions 43 project up into the cavities 13 through the shorting opening 19.

The front holder 70 then is mounted on the female housing 10 (see FIG. 10), and lower sides of the escaping portions 23 are closed by the insulating portions 75.

The female terminal fittings 30A, 30B then are inserted into the respective cavities 13 while the retainer 60 is held at the partial locking position. The female terminal fittings 30A, 30B inserted into the cavities 13 from behind are locked primarily by the resin locking lances 14 when reaching a proper position. The first terminal fittings 30A to be shorted by the shorting terminal 40 are inserted into the first cavities 13A to the proper position while resiliently deforming the resilient contact piece 41 projecting down, and is locked by the resin locking lance 14 in a state held in contact with the contact portion 43 of the resilient contact piece 41, i.e. in a shorted state. In this state, the tip of the resilient contact piece 41 is above the lower partition wall 22 (see FIG. 1).

The retainer 60 then is moved to the full locking position so that each female terminal fitting 30 is locked secondarily by the retaining portion 62 to complete the assembly of the female connector F.

Figure 2:
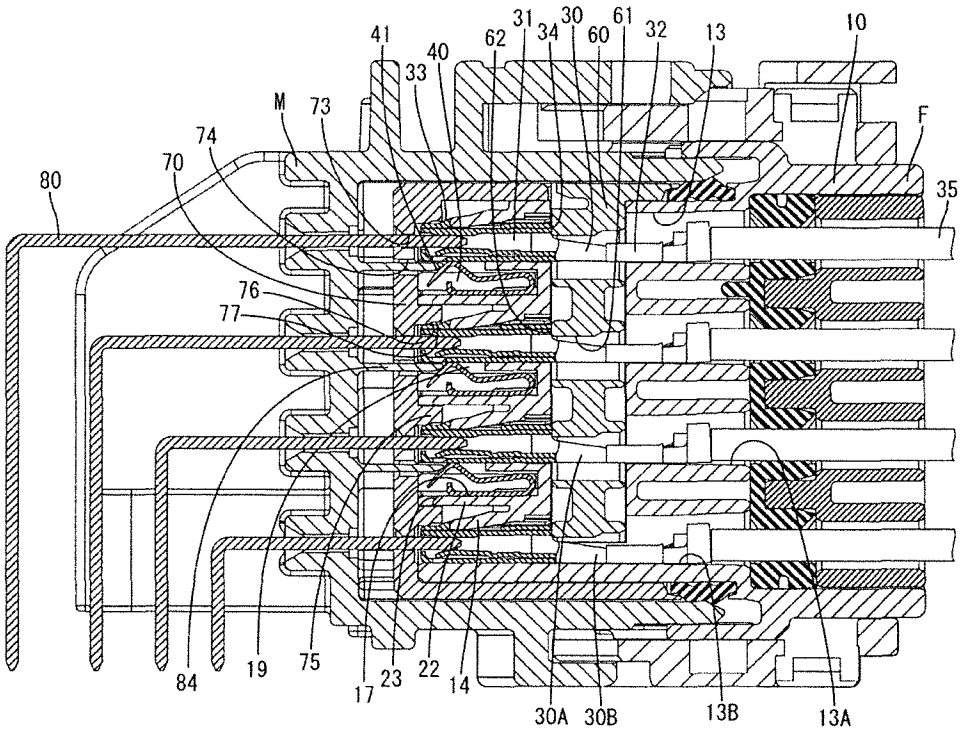
FIG. 2 is a section showing a state while the female and male connectors are being connected.

When the female and male connectors F, M are connected, the male terminal fittings 80 are inserted through the terminal insertion openings 73 of the front holder 70 and into the connecting portions 31 of the specific terminal fittings 30A accommodated in the cavities 13 to be electrically conductively connected to the female terminal fittings 30, as shown in FIG. 2. At this time, the short releasing portions 84 are inserted through the short releasing holes 74 of the front holder 70 and into the shorting openings 19 of the female housing 10 to reach positions before the resilient contact pieces 41.

As the connecting operation proceeds, the male terminal fittings 80 are inserted farther back. Additionally, the short releasing portions 84 are inserted deeply into the shorting openings 19, contact the guiding portions 44 of the resilient contact pieces 41 to deform the resilient contact pieces 41 down and thrust themselves between the connecting portions 31 of the first terminal fittings 30A and the resilient contact pieces 41 of the shorting terminals 40. At this time, the tips of the resilient contact pieces 41 escape into the escaping portions 23 without contacting the lower partition walls 22. In this way, a shorted state between two of the first terminal fittings 30A is released by the short releasing portion 84 that has been between the first terminal fittings 30A and the shorting terminal 40. At this time, the tips of the resilient contact pieces 41 are located in a height range equivalent to that of the inclined surface 25B of the escaping portion 23. Thus, the female and male connectors F, M reach the properly connected state.

As described above, the lower partition wall 22 between the shorting terminal accommodating chamber 17 and the second cavities 13B is formed with the escaping portion 23 for allowing the resilient contact pieces 41 resiliently deformed by the short releasing portion 84 to escape, and the insulating portion 75 for insulating between the resilient contact pieces 41 and the second terminal fittings 30B is provided below the escaping portion 23. Thus, the resilient contact pieces 41 pressed by the short releasing portion 84 deform resiliently while escaping into the escaping portion 23 so that the height of the shorting terminal 40 can be reduced. Further, the resilient contact pieces 41 and the second terminal fittings 30B, which are not supposed to be shorted, are insulated by the insulating portion 75, an electrical short circuit between the shorting terminal 40 and the second terminal fittings 30B, which are not supposed to be shorted by this shorting terminal 40, can be prevented. Thus, the miniaturization of the shorting terminal 40 and an improvement in insulation performance can be combined.

Further, the resin locking lance 14 extending from the lower partition wall 22 and configured to lock and retain the second terminal fitting 30B accommodated in the second cavity 13B is provided in the second cavity 13B, and the insulating portion 75 is arranged proximate to the lower partition wall 22. This enables the height of the female housing 10 to be reduced as compared with the case where insulating portions and resin locking lances are arranged at positions completely displaced in the height direction. Specifically, if the resin locking lance is, for example, provided at a lower surface side of the cavity, the position of the lower surface of the cavity needs to be lowered to ensure a deformation space for the resin locking lance between the resin locking lance and the lower surface of the cavity. That is, since the deformation space needs to be provided at the lower surface side in addition to a space provided at an upper surface side of the cavity for arranging the insulating portion, the height of the housing is increased by that much. Contrary to this, in the female connector F of this embodiment, it is not necessary to vertically separately provide the deformation spaces 15 for the resin locking lances 14 and the spaces for arranging the insulating portions 75. Therefore the height of the female housing 1 can be reduced and miniaturization can be realized.

The invention is not limited to the above described embodiment. For example, the following embodiments also are in the scope of the invention.

The escaping portion 23 is open forward in the above embodiment. However, the escaping portion may be a through hole penetrating in the vertical direction while being surrounded on four sides.

The projecting end of the insulating portion 75 is proximate to or in contact with the lower surface of the lower partition wall 22 in the above embodiment. However, there is no limitation to this and the insulating portion may be arranged below and away from the lower partition wall.

The insulating portion 75 has a size to close the entire escaping portion 23 without leaving any clearance in the above embodiment, but it may have other dimensions.

The insulating portion 75 entirely overlaps the resin locking lance in the front-back direction in the above embodiment. However, a part of the insulating portion may project farther down than the resin locking lance.

The invention is applied to the female connector F in which the shorting terminal accommodating chambers 17 are arranged between the cavities 13 arranged in the four stages in the above embodiment. However, the number of cavities and the number of the shorting terminal accommodating chambers are not limited to these. The present invention can be applied to any connector provided that cavities are arranged in at least two stages and the connector includes shorting terminal accommodating chambers between the cavities.

The invention is embodied on the female connector side as described above, but is equally applicable to a male connector side.

The invention is embodied on a connector having a lever to assist or perform a connection to a mating connector. However, it can be embodied in a connector with no a lever or with a different type of connection operation assistance function.

REFERENCE SIGNS

F . . . female connector (connector)
M . . . male connector (mating connector)
10 . . . female housing (housing)
13 . . . cavity
13A . . . first cavity
13B . . . second cavity
14 . . . resin locking lance
17 . . . shorting terminal accommodating chamber
22 . . . lower partition wall (partition wall)
23 . . . escaping portion
30 . . . female terminal fitting (terminal fitting)
30A . . . first terminal fitting
30B . . . second terminal fitting
40 . . . shorting terminal
41 . . . resilient contact piece
70 . . . front holder
75 . . . insulating portion
84 . . . short releasing portion

What is claimed is:

1. A connector, comprising:

a housing with opposite front and rear ends, at least one shorting terminal accommodating chamber extending into the front end, first cavities on a first side of the shorting terminal accommodating chamber and second cavities on a second side of the shorting terminal accommodating chamber, a partition wall between the second cavities and the shorting terminal accommodating chamber, resiliently deflectable locking lances projecting from the partition wall into the second cavities and at least one escaping opening in the partition wall at a position forward of the locking lances;

first terminal fittings accommodated in the first cavities;

second terminal fittings accommodated in the second cavities; and at least one shorting terminal accommodated in the shorting terminal accommodating chamber, the shorting terminal having resilient contact pieces contacting the first terminal fittings to short between the first terminal fittings when the connector is not connected to a mating connector and the resilient contact pieces being deflected into the at least one escaping opening to release a shorted state of the first terminal fittings when the connector is connected properly to the mating connector.

2. The connector of claim 1, further comprising a front holder is to be mounted on a front surface of the female housing and includes at least one insulating portion for insulating between the resilient contact pieces and the second terminal fittings by preventing the entrance of the resilient contact pieces from the escaping portion.

3. The connector of claim 2, wherein the at least one insulating portion has such a size as to be able to close the substantially entire escaping portion without leaving any clearance.

4. The connector of claim 2, wherein the front holder is to be mounted to at least partly cover the housing from front.

5. A connector according to claim 1, wherein a rear wall is provided at or near a rear end part of the shorting terminal accommodating chamber , wherein the shorting terminal at least partly accommodated in the shorting terminal accommodating chamber is retained so as not to move backward by the rear wall.

6. The connector of claim 1, wherein an excessive deflection preventing portion for preventing excessive deflection of the resilient contact piece is provided adjacent to the resilient contact piece.

* * * * *